US006969113B2

(12) United States Patent
Krawchuk

(10) Patent No.: US 6,969,113 B2
(45) Date of Patent: Nov. 29, 2005

(54) FOLDING CHAIR WITH METAL INSERTS

(76) Inventor: Dennis Michael Krawchuk, 6/10 Pioneer Ave., Thornleigh, New South Wales 2120 (AU)

( * ) Notice: Subject to any disclaimer, the term of this patent is extended or adjusted under 35 U.S.C. 154(b) by 0 days.

(21) Appl. No.: 10/856,825

(22) Filed: Jun. 1, 2004

(65) Prior Publication Data

US 2005/0012370 A1 Jan. 20, 2005

(30) Foreign Application Priority Data

| | | |
|---|---|---|
| Jun. 3, 2003 | (AU) | 2003902771 |
| Jan. 7, 2004 | (AU) | 2004900048 |
| Mar. 9, 2004 | (AU) | 2004901178 |

(51) Int. Cl.[7] ..... A47C 3/04; A47C 5/12; A47C 7/16; A47C 4/08; A47C 4/10

(52) U.S. Cl. ..... 297/23; 297/239; 297/452.18; 297/452.2; 297/451.11; 297/DIG. 2

(58) Field of Search ..... 297/23, 239, 452.2, 297/452.18, DIG. 2, 451.11

(56) References Cited

U.S. PATENT DOCUMENTS

| | | | | |
|---|---|---|---|---|
| 4,345,666 | A * | 8/1982 | Mathou | 297/DIG. 2 X |
| 5,096,259 | A * | 3/1992 | Stanfield | 297/239 |
| 5,738,408 | A * | 4/1998 | Wu | 297/239 |
| 6,099,073 | A * | 8/2000 | Bruschi | 297/239 X |
| 6,592,182 | B1 * | 7/2003 | Noor | 297/239 |
| 6,669,281 | B1 * | 12/2003 | Huang | 297/239 X |
| 6,742,839 | B2 * | 6/2004 | Piretti | 297/239 |
| 6,863,341 | B1 * | 3/2005 | Wen | 297/23 |
| 6,890,026 | B1 * | 5/2005 | Shin | 297/239 X |
| 6,905,168 | B2 * | 6/2005 | Noor | 297/239 |
| 2004/0004371 | A1 * | 1/2004 | Noor | 297/239 X |

* cited by examiner

*Primary Examiner*—Rodney B. White
(74) *Attorney, Agent, or Firm*—Molins & Co.

(57) ABSTRACT

A plastic folding chair comprises a support frame, a main frame and a seat frame. The support frame further comprises a pair of parallel rear legs. Each rear leg is reinforced by an internal insert and may haves a rear surface incorporating a wedge that facilitates stacking.

20 Claims, 8 Drawing Sheets

FOLDING CHAIR WITH METAL INSERTS

FIELD OF THE INVENTION

The invention pertains to folding chairs and more particularly to a plastic folding chair with metal inserts located in strategic locations.

BACKGROUND OF THE INVENTION

Folding chairs are in wide use. One popular use for a folding chair is the rental or hire market. Such chairs are used by businesses that rent chairs for quick deployment and collection, at functions where chairs would not otherwise be present. Traditional folding chairs are wooden although plastic folding chairs are known. Particularly for the rental or hire market, folding chairs must be sturdy and capable of absorbing abusive handling. Further, the chairs must be stackable so they may be stored and transported economically. It is also preferred that stacks of chairs be susceptible to greater rather than lesser heights during storage and transport. It is important that chairs do not slide off their stack as this can result to inconvenience and injury.

One such folding plastic chair shown in U.S. Pat. No. 6,099,073. Note that this type of folding chair fails to precisely resemble traditional wooden folding chairs because of the presence of prominent special molded-in features. Further, it is known that people will tend to rock on this type of chair and that when doing so, excessive stresses are placed on, particularly, the rear legs. This can result in deformation, damage or breakage to the chair. Accordingly, the useful lifetime of the chair is reduced and therefore the profitability of the rental business is reduced. Some plastic chairs are uncomfortable.

Another type of plastic folding chair is seen in U.S. Pat. No. 6,592,182. This type of chair has no metal reinforcement in the seat or along the legs. As mentioned above, rocking on this type of chair can result in excessive stresses, for example, on the rear legs.

OBJECTS AND SUMMARY OF THE INVENTION

It is an object of the invention to provide a plastic folding chair with enhanced mechanical properties.

It is also an object of the invention, which provides a plastic folding chair with stable stacking characteristic.

Accordingly, the invention provides a plastic folding chair compromising a support frame, a main frame and a seat frame. The support frame further comprises a pair of parallel legs and each of the legs is reinforced with an internal, molded in, metal reinforcement.

Another embodiments of the inventions, the left and right side elements of the seat are also reinforced with a metal insert.

It is also an object of the invention to provide a plastic folding chair with stable stacking characteristics.

Accordingly, some embodiments provide a plastic folding chair compromising a support frame, a main frame and a seat frame. The support frame further comprises a pair of parallel rear legs. Each rear leg has a rear surface and the lower end of the rear surface incorporates a wedge that facilitates stacking.

BRIEF DESCRIPTION OF THE DRAWING FIGURES

Figure 9:
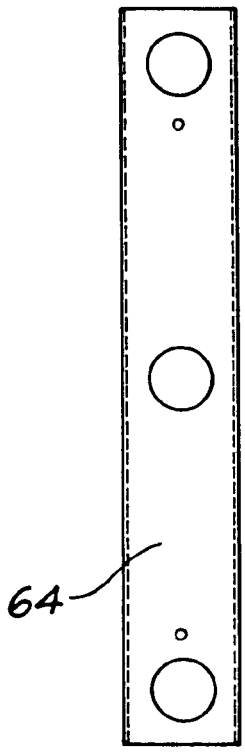
FIG. 9 is a plan view of a metal insert for a seat frame.
Figure 9A:
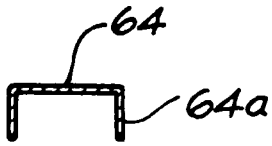
Figure 10:
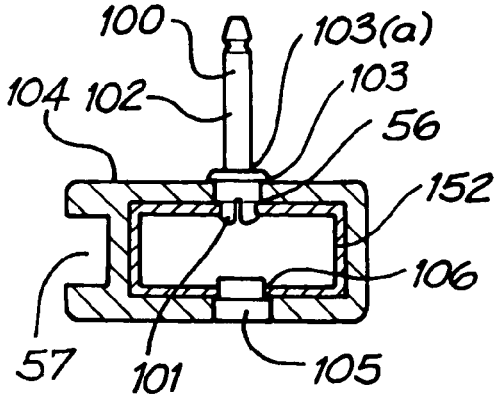
Figure 11:
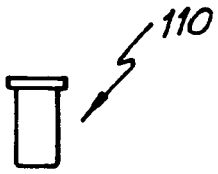
Figure 12:
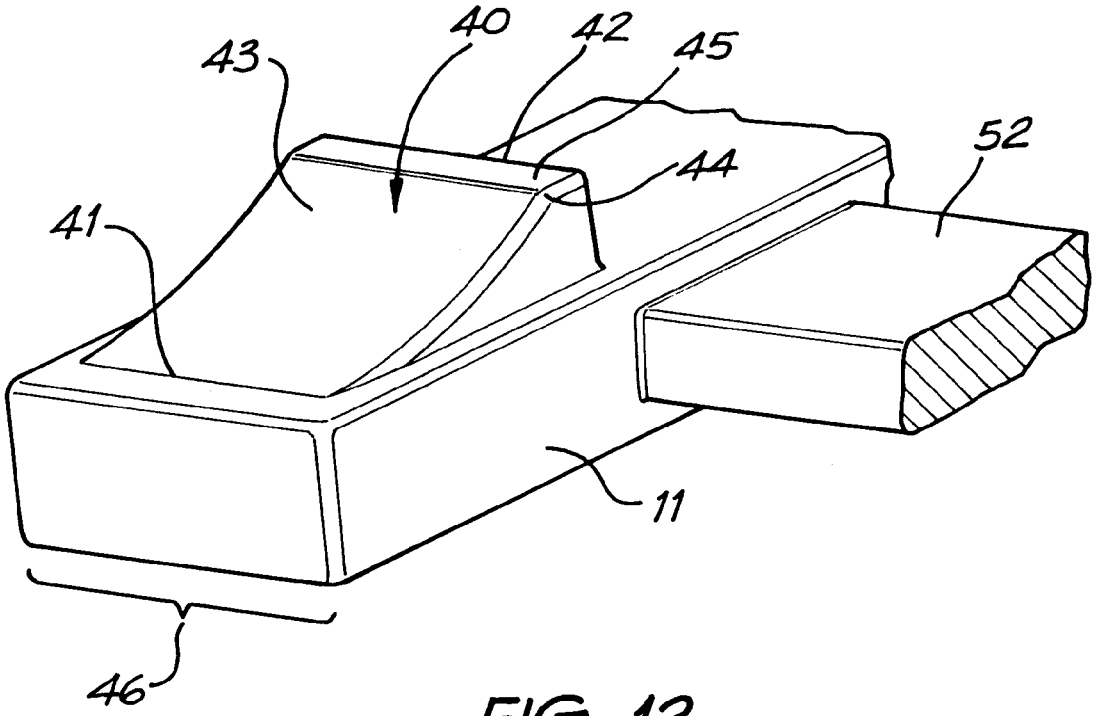
Figure 13:
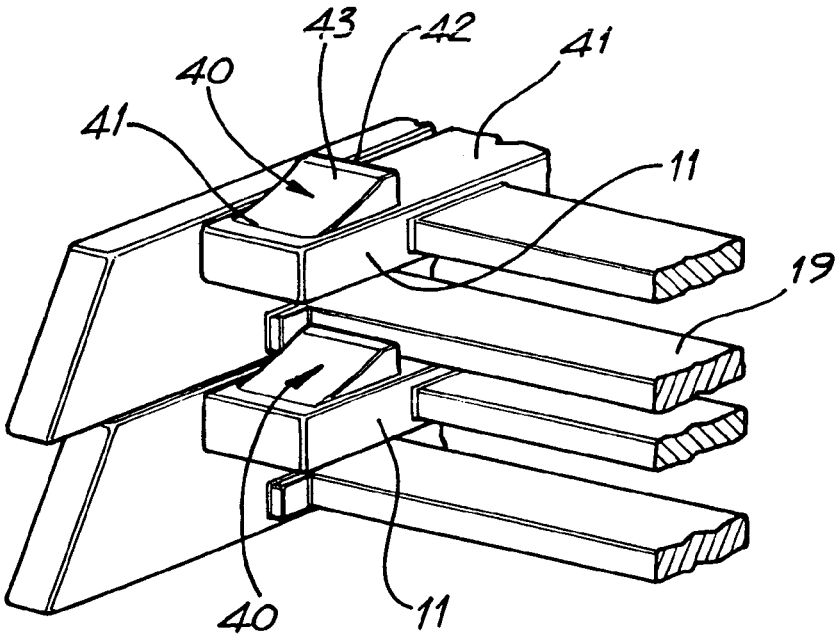
Figure 14:
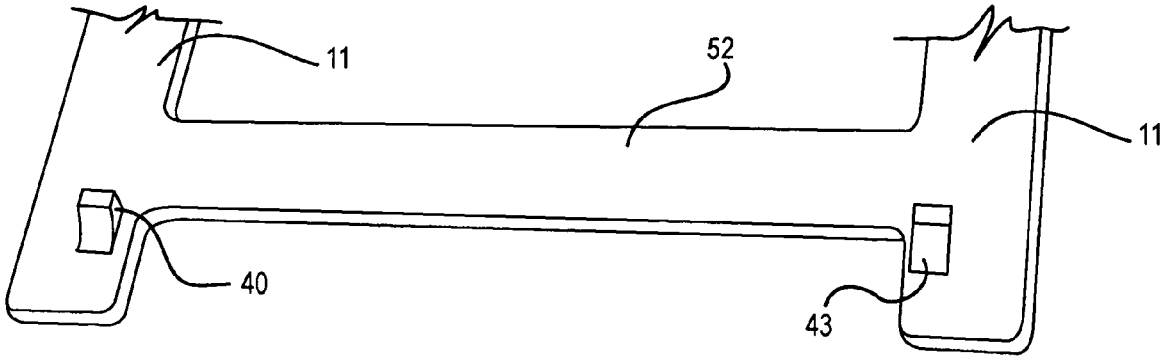

FIG. 9*a* is a cross sectional view of a metal insert for a seat frame;

FIG. 10 is a cross sectional view of a portion of the support frame showing the positioning of the metal insert with a retaining pin;

FIG. 11 is a plan view of a plug;

FIG. 12 is a perspective view of a stacking wedge;

FIG. 13 is a perspective view of stacked chairs according to the teachings of the present invention; and FIG. 14 is a perspective view showing partial width stacking wedges.

BEST MODE AND OTHER EMBODIMENTS OF THE INVENTION

Figure 1:
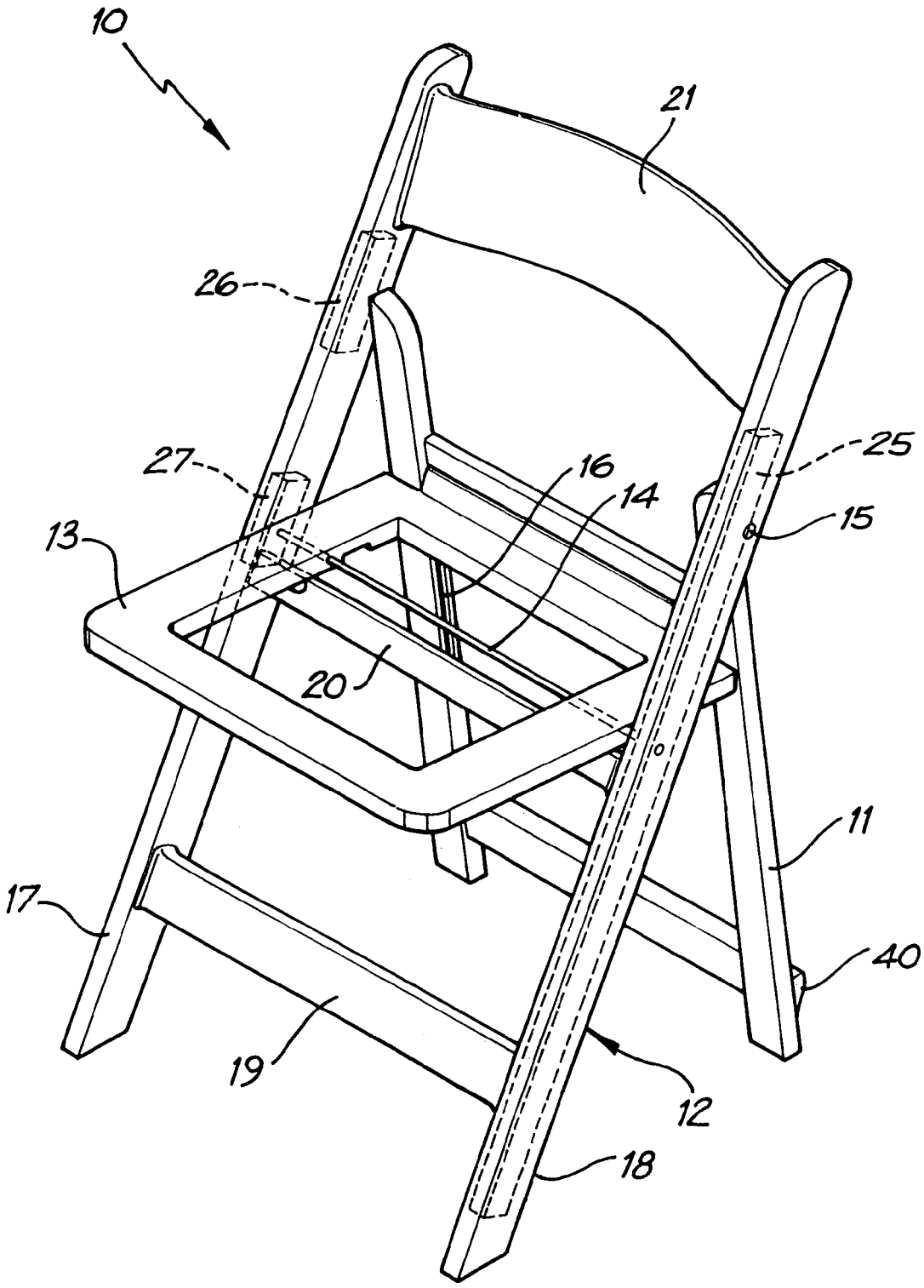
FIG. 1 is a perspective view of a chair according to the teachings of the present invention.

As shown in FIG. 1, a flat-folding plastic chair 10 comprises a support frame 11, a main frame 12 and a seat frame 13. A metal rod or other seat pivot member14 extends between an intermediate portion of the left and right sides or legs of the main frame 12 and the seat frame 13 pivots about this rod 14. The pivoting movement of the seat is inhibited by an upper cross member 53 of the support frame so that the unfolded chair is stable. The support frame 11 pivots about the main frame 12 by the use of a pair of cap screws and fastening heads 15 which are set flush or below the surface of the main frame and support frame. Two opposed and inward facing channels 16 are formed in the support frame 11 and guide a pair of integral pins formed in the rear of seat frame 13.

The main frame 12 has a close resemblance to the main frames of wooden chairs. It comprises left and right legs 17, 18 a lower transverse cross member or foot rest 19 a transverse seat supporting cross member 20 and an upper cross member or backrest 21. The backrest may be conveniently contoured for user comfort.

Figure 2:
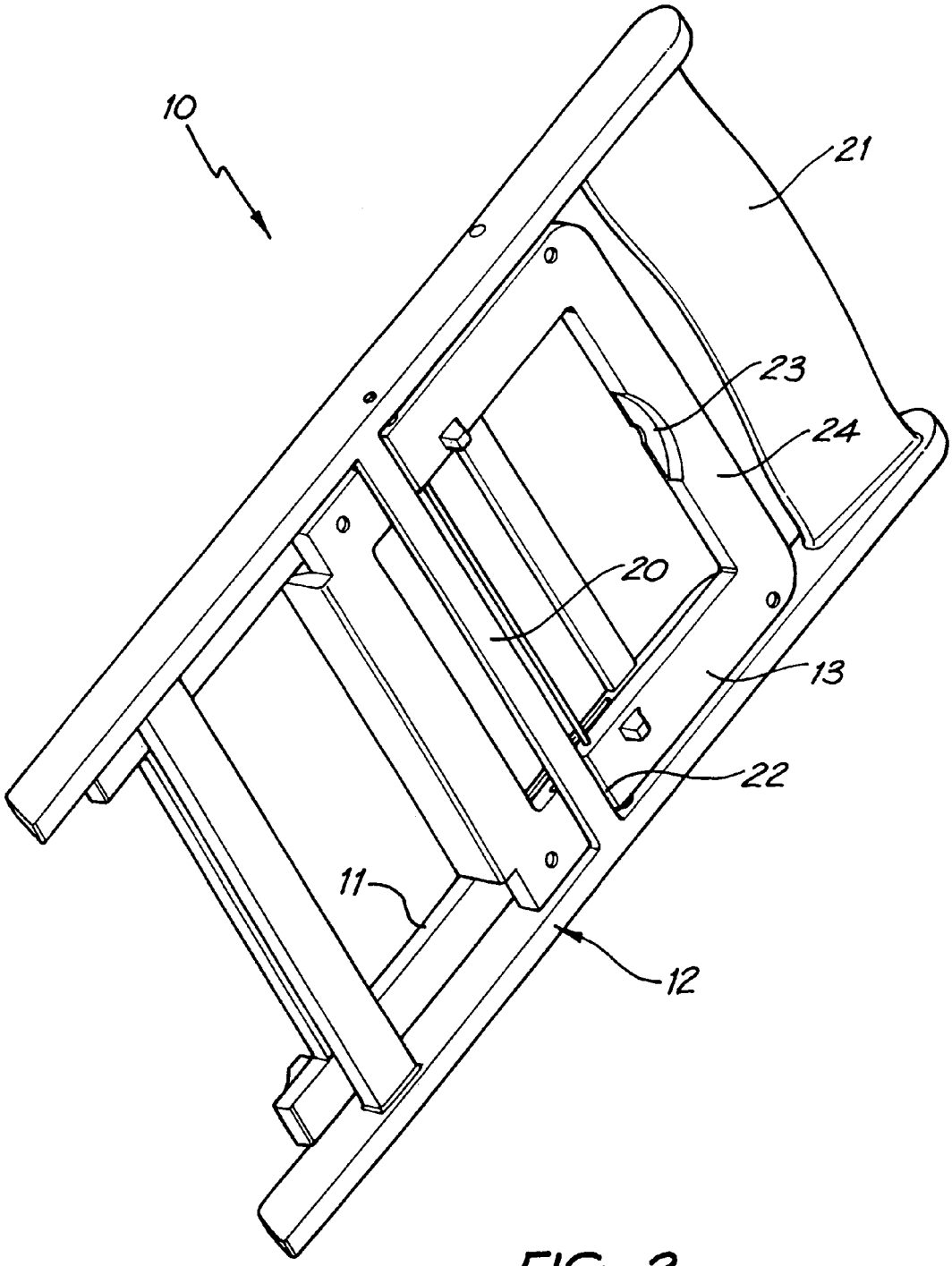
FIG. 2 is a perspective view of the chair shown in FIG. 1, in a folded flat position.

As shown in FIG. 2, the chair is capable of folding flat. In some embodiments, recesses 22 may be formed into the under side of the seat frame 13 to accommodate the seat support 20 which is integral with the main frame 12. Also visible in FIG. 2 is a scallop 23 formed in the underside of the seat frame along the central portion of the seat's front cross member 24. This scallop or depression 23 cooperates with a pivoting lever 30 that is attached to the underside 31 of the padded seat insert 31 of the padded seat insert 32.

Figure 3:
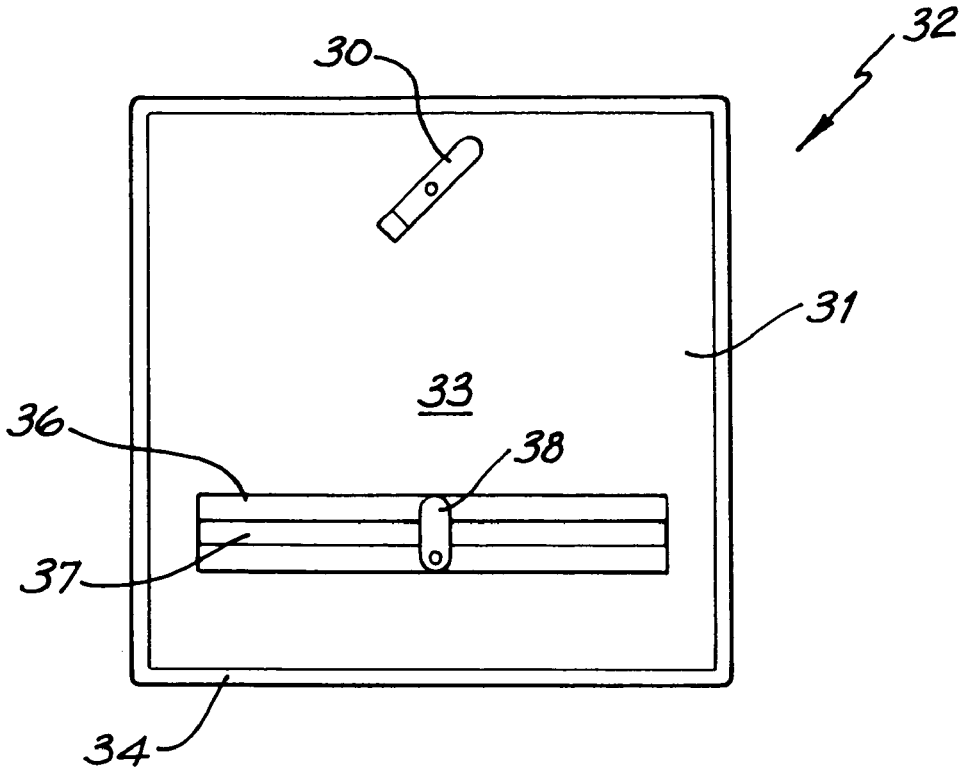
FIG. 3 is a bottom plan view of a seat element.
Figure 4:
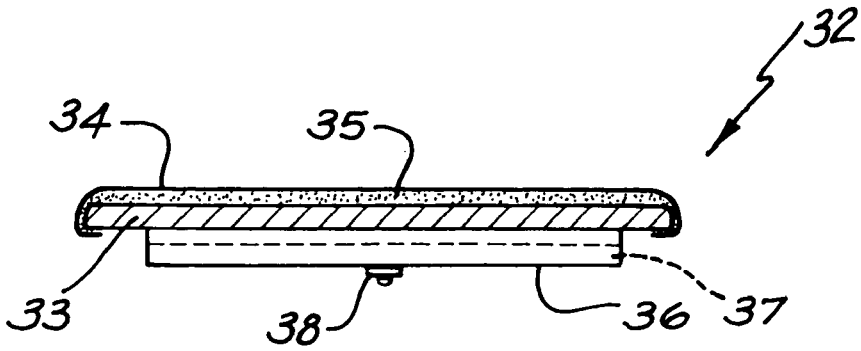
FIG. 4 is a side elevation of the element depicted in FIG. 3.

As shown in FIGS. 3 and 4 the seat insert or element 32 comprises a ridged base 33 that is preferably covered in a flexible textile sheet 34. A foam pad 35 may be interposed between the outer cover 34 and the ridged base or support 33. The seat insert 32 also features a seat brace 36 in the form of a wooden block having a transverse channel 37. The length of the block 36 is adapted to fit between the side members of the seat such that the groove 37 may lie on top of and engage the rod 14. The perimeter of the seat insert or element 32 is supported by the upper surface of the seat 13. The seat insert 32 is retained by the pivoting lever 30 when it engages the seat frame in the area of the scallop 23 and also by virtue of a tang and fastener 38 that essentially traps the rod 14 in the grove 37.

Figure 5:
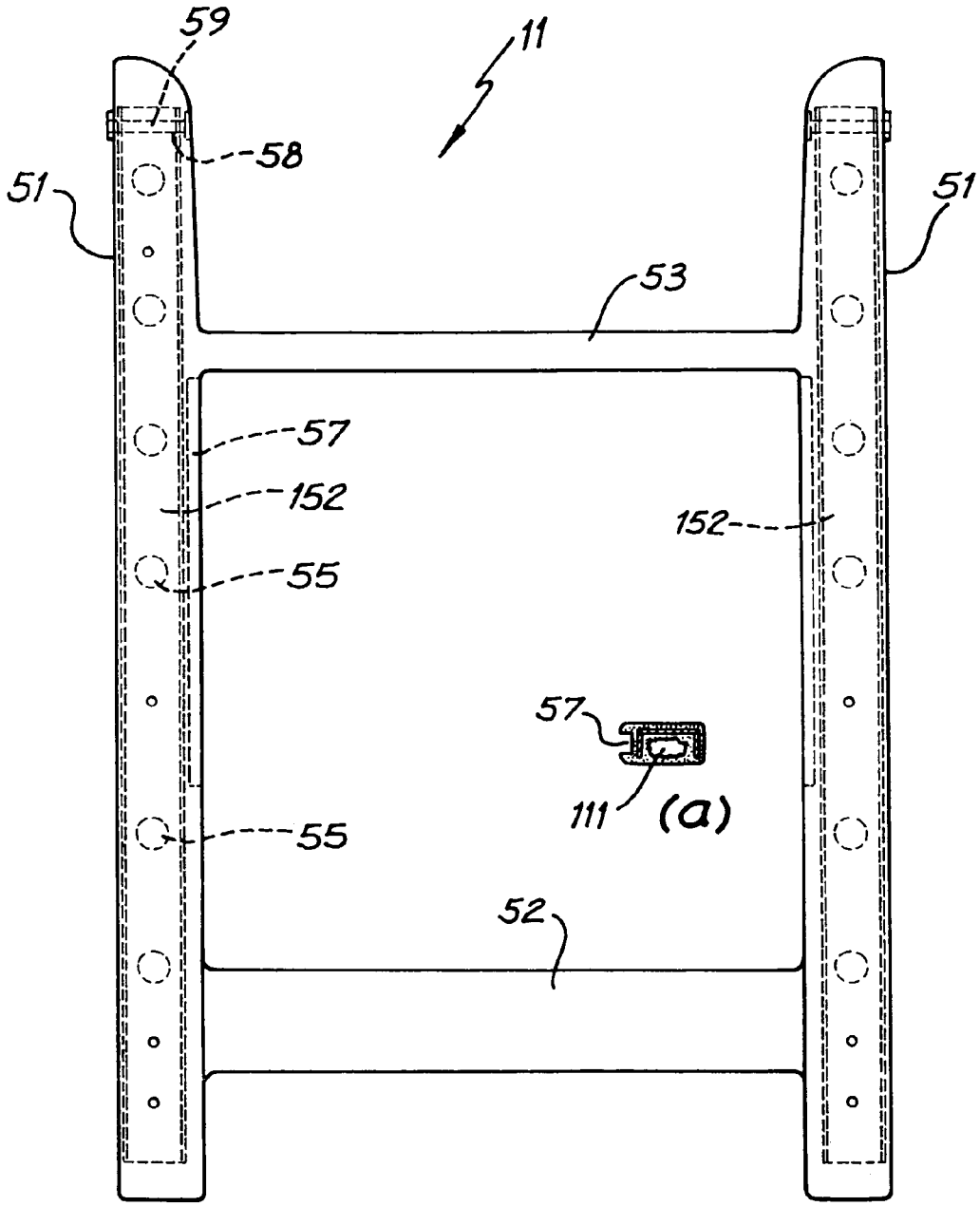
FIG. 5 is a rear elevation of a support frame.

As shown in FIG. 5, the support frame 11 comprises a pair of left and right side members or legs 51 which are interconnected by an integral lower cross member 52 and upper cross member 53. The upper cross member 53 serves the important purpose of taking the stress imposed by the rear of the pivoting seat frame when weight is placed in front of the rod 14 and on the seat frame.

Figure 8:
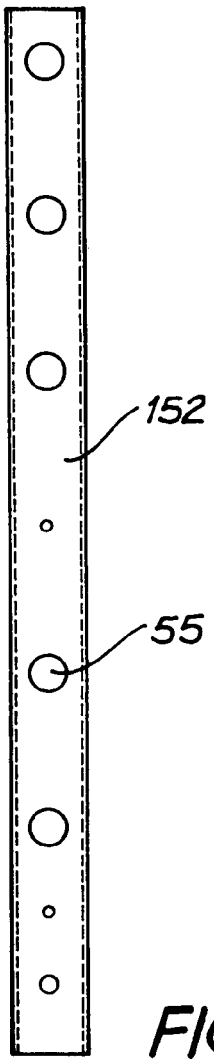
FIG. 8 is a plan view of a support frame metal insert.

Importantly, each of the side members 51 is reinforced with an insert 152. It will be understood that other metals such as aluminum may be used to save weight. Even high strength polymers or composites may be used. We use steel here as an example. As shown in FIGS. 5, 8 and 10, the steel insert 152 (for the support frame) preferably comprises a rectangular or square tube shaped channel that extends nearly the length of the entire side member or leg 51. It will be understood that the term "rectangle" technically includes square sections. It may include a number of optional openings 55 along its length for weight reduction. The steel or other reinforcement may also include secondary openings 56 which are used in the positioning of the insert within the mold in which the support frame is fabricated using holder pins. In some embodiments the square or rectangular tube inserts are capped and provided without the vent holes 55. This method alleviates the need for gas injection. As shown in FIG. 10, a plastic positioning pin 100 has a bottom 101 which can frictionally engage the secondary holes 56 and support the insert within a mold and away from the mold wall prior to and during the injection molding process. Other positioning devices 105 are located in openings 106 formed in the insert 152. Preferably these openings 106 are located on the opposite side of the insert 152 from the positioning pins 100. The positioning devices 105 act as a spacer between the mold cavity and the insert 152 and thereby maintain the accurate positioning of the insert in the mould cavity. In practice the insert with pins 100 and spacer devices 105 in inserted into the mould cavity with the pins entering retaining holes in the cavity. At the end of the molding process, the support frame 11 with pins 100 is removed from the mold and the shaft of the pin 102 is removed below 103(*a*) its base 103 or preferably above the base 103(*a*) so that the remainder of the pin is almost flush with the surface 104 of the support frame. Also note that the insert 152 carries a pair of openings 58 at its upper end that register with the transverse channel 59 that is used to receive the cap screw or other pivot member 15. Thus a significant load bearing and pivoting portion of the support frame is essentially reinforced by the insert 152 with regard to its contact with the main frame 18.

It is also an advantage that, during the injection molding of the steel reinforced frames of the present invention, pressurized nitrogen be injected into the interior or exterior of the steel channel. This reduces the weight of the chair and the amount of plastic consumed. As shown in FIG. 5*a*, a longitudinal air pocket 111 is formed by injecting (dry) nitrogen into the steel channel during plastic injection. Any air entry opening in the surface of the molded part is permanently covered by a small cap 110 as shown in FIG. 11.

Similarly to the arrangement shown in FIG. 5, a metal insert in the form of a square or rectangular tube can be used to stiffen and strengthen the front leg portions of the main frame 11. As shown in FIG. 1, a full-length metal insert 25 can be inserted into a mould cavity before the leg is molded. It is particularly advantageous that the insert be drilled transversely to accept the fastener 15 about which the legs 12 pivot and if necessary, to accept the rod 14.

In some embodiments, only that portion of the main frame or front leg 12 adjacent to the fastener 15 is reinforced by a shorter length 26 of insert or reinforcement. Other areas of the legs such as the area of the seat pivot 27 or the expanses of leg between the pivots can be selectively reinforced with short inserts. This method of reinforcement provides stress relief in key areas but weighs less than using full-length inserts.

Figure 6:
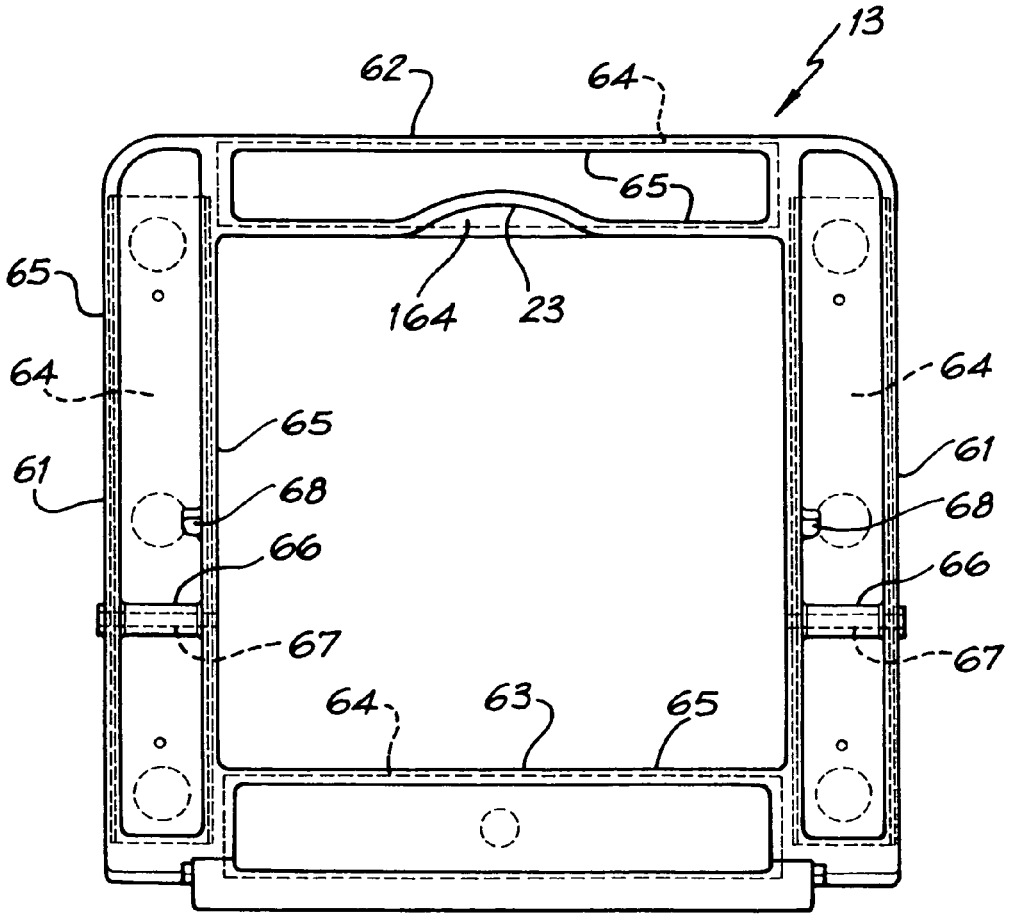
FIG. 6 is a bottom plan view of a seat frame.
Figure 7:
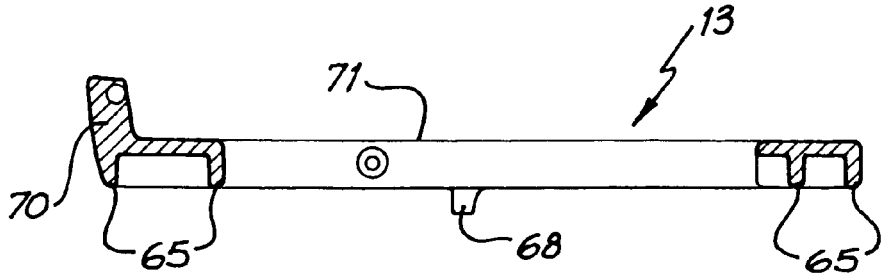
FIG. 7 is a side elevation of this seat frame depicted in FIG. 6.

As shown in FIGS. 6 and 7, the seat frame 13 comprises seat frame side members 61 which are interconnected by a front portion 62 and a rear portion 63. In preferred embodiments, only the two side members of the seat 61 are reinforced with "U" shaped (or even "L" shaped) channel 64 as shown in FIGS. 6 and 9. Because FIG. 6 is a view from the bottom of the seat frame, scallop 23 is clearly visible as is the thin upper thinned section 164 that engages the pivoting lever 30 (shown in FIG. 4). The under side features a network of reinforcing ribs 65 which surround each of the webs which define the upper surface of the seat frame. The ribs also locate the arms 64*a* of the "U" shaped channels 64. A boss 66 traverses the parallel ribs 65 which define the side members and provides a thickened portion for a receiving a transverse bore or opening 67 through which the rod 14 passes. The under side of the seat frame also features alignment pins 68 which extend away from the underside of the seat frame 13 and engage with the internal edges of a support frame of an adjacent folding chair when the two are in a stacking position. The alignment pin 68 resists lateral movement and assist in the stabilization of the stack. The rear transverse element 63 of the seat frame 13 further comprises a ridge 70 that extends upwardly from the upper surface 71 of the seat frame 13. The ridge 70 is used to make contact with the support frame's upper cross member 53. In some embodiments the front and rear transverse elements of the seat 62, 63 can be reinforced with steel channels 64 just as described with reference to the side members 61. In some embodiments a single steel frame-like insert reinforcement can be used in place of four separate channels 64.

As shown in FIGS. 12–14, a stacking wedge 40 is located toward or at the bottom of the rear-facing surface of each of the rear legs 11. The wedge 40 resembles a wave that blends smoothly from the rear surface 41 to a maximum height 42 that occurs toward the top of the leg. In preferred embodiments, the rear surface 43 of the wedge is gently concave and includes a transition 44 to a short flat surface 45 that is adjacent to the area of maximum height 42. It is preferred that the wedge or wave 40 occupies substantially the full width 46 of each leg 11. Wedges of this configuration are easy to clean after outdoor use.

As shown in FIG. 13, when the chairs are stacked, the wedges 40 interfere with the footrest 19 of an adjacent chair. This mechanical interference stabilizes adjacent chairs and therefore a stack of chairs that incorporate the above referenced features.

A shown in FIG. 14, the stacking wedge 40 may be partial width across the leg and need not extend the full width of the leg.

Accordingly, what has been disclosed is a ridged and rugged folding plastic chair having metallic inserts in key locations. The primary requirement for metallic reinforcement occurs in the side members of the support frame but is also particularly advantageous in the seat as previously discussed. Other advantages of the invention include the stacking wedges 40.

While the invention has been described with reference to particular details of construction, these should be understood as examples and not as limitations to the scope of the invention as expressed in the claims.

What is claimed is:

1. A flat-folding plastic chair comprising:

a main frame, a support frame and a seat frame;

the main frame hinged to an upper portion of the support frame;

the seat frame pivotally attached to and supported by a seat pivot member located in an intermediate portion of the main frame;

the support frame having two legs, the support frame and the two legs being fabricated from molded plastic, each leg reinforced by an internal insert.

2. The chair of claim 1, wherein:

the upper portion of support frame further comprises a channel for receiving a pivot member;

each reinforcement having an upper section in which is formed a transverse opening for cooperating with the channel and receiving the pivot member.

3. The chair of claim 1, wherein:

the support frame has integral lower and upper cross members.

4. The chair of claim 3, wherein:

the reinforcement extends at least between the lower and upper cross members.

5. The chair of claim 1, wherein:

the main frame has left and right legs and each is reinforced by a second internal insert.

6. The chair of claim 5, wherein:

the second insert is located in the intermediate portion in the area of the seat pivot member.

7. The chair of claim 1, wherein:

the seat frame has side members that are each reinforced by an internal seat frame insert.

8. The chair of claim 7, wherein:

the internal seat frame inserts are metal and each is formed with a transverse through opening for receiving the seat pivot member.

9. A flat-folding plastic chair comprising:

a main frame, a support frame and a seat frame;

the main frame hinged to an upper portion of the support frame;

the seat frame pivotally attached to and supported by a seat pivot member located in an intermediate portion of the main frame;

the support frame having two legs, the support frame and the two legs being fabricated from molded plastic;

each leg having a rear surface, at the bottom of which is a stacking wedge, each leg reinforced by an internal insert.

10. The chair of claim 9, wherein:

the wedge is shaped like a wave that blends smoothly from the rear surface to a region of maximum height.

11. The chair of claim 10, wherein:

the region of maximum height is located toward the top of the leg.

12. The chair of claim 10, wherein:

a rear surface of the wedge is gently concave and includes a transition to a short flat surface that is adjacent to the region of maximum height.

13. The chair of claim 9 wherein:

the wedge occupies substantially a full width of each leg.

14. The chair of claim 9, wherein:

when the chairs are stacked, the wedges interfere with a transverse footrest of an adjacent chair.

15. A flat-folding plastic chair comprising.

a main frame, a support frame and a seat frame;

the main frame hinged to an upper portion of the support frame;

the seat frame pivotally attached to and supported by a seat pivot member located in an intermediate portion of the main frame;

the seat frame having two legs, the seat frame and the two legs being fabricated from molded plastic, each leg reinforced by an internal insert.

16. The chair of claim 15, wherein:

the insert is located in the intermediate portion in the area of the seat pivot member.

17. The chair of claim 15, wherein:

the seat frame has side members that are each reinforced by an internal seat frame insert.

18. The chair of claim 17, wherein:

the internal seat frame inserts are each formed with a transverse through opening for receiving the seat pivot member.

19. The chair of claim 1, wherein:

the insert further comprises a metal tube of rectangular cross section.

20. The chair of claim 1, wherein:

the insert contains a gas space that is blown into the insert during the injection molding process.

* * * * *

US006969113C1

(12) EX PARTE REEXAMINATION CERTIFICATE (10068th)

United States Patent

Krawchuk

(10) Number: US 6,969,113 C1

(45) Certificate Issued: Mar. 4, 2014

(54) FOLDING CHAIR WITH METAL INSERTS

(76) Inventor: Dennis Michael Krawchuk, Thornleigh (AU)

Reexamination Request:
No. 90/012,457, Sep. 15, 2012

Reexamination Certificate for:

| | |
|---|---|
| Patent No.: | **6,969,113** |
| Issued: | **Nov. 29, 2005** |
| Appl. No.: | **10/856,825** |
| Filed: | **Jun. 1, 2004** |

(30) Foreign Application Priority Data

| | | |
|---|---|---|
| Jun. 3, 2003 | (AU) | 2003902771 |
| Jan. 7, 2004 | (AU) | 2004900048 |
| Mar. 9, 2004 | (AU) | 2004901178 |

(51) Int. Cl.

| | |
|---|---|
| ***A47C 3/04*** | (2006.01) |
| ***A47C 5/12*** | (2006.01) |
| ***A47C 7/16*** | (2006.01) |
| ***A47C 4/08*** | (2006.01) |
| ***A47C 4/10*** | (2006.01) |

(52) U.S. Cl.
CPC . *A47C 3/04* (2013.01); *Y10S 297/02* (2013.01)
USPC ..... 297/23; 297/239; 297/452.18; 297/452.2; 297/451.11; 297/DIG. 2

(58) Field of Classification Search
None
See application file for complete search history.

(56) References Cited

To view the complete listing of prior art documents cited during the proceeding for Reexamination Control Number 90/012,457, please refer to the USPTO's public Patent Application Information Retrieval (PAIR) system under the Display References tab.

*Primary Examiner* — Danton DeMille

(57) ABSTRACT

A plastic folding chair comprises a support frame, a main frame and a seat frame. The support frame further comprises a pair of parallel rear legs. Each rear leg is reinforced by an internal insert and may haves a rear surface incorporating a wedge that facilitates stacking.

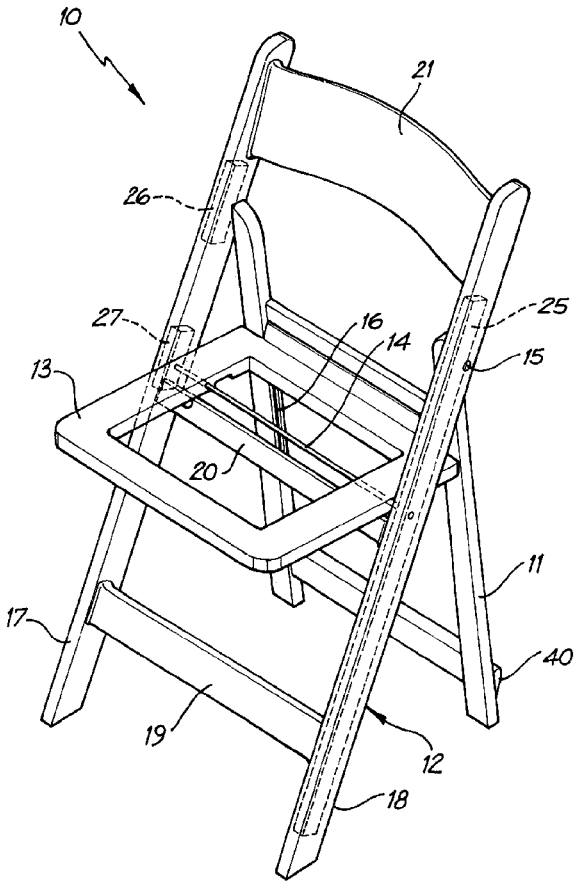

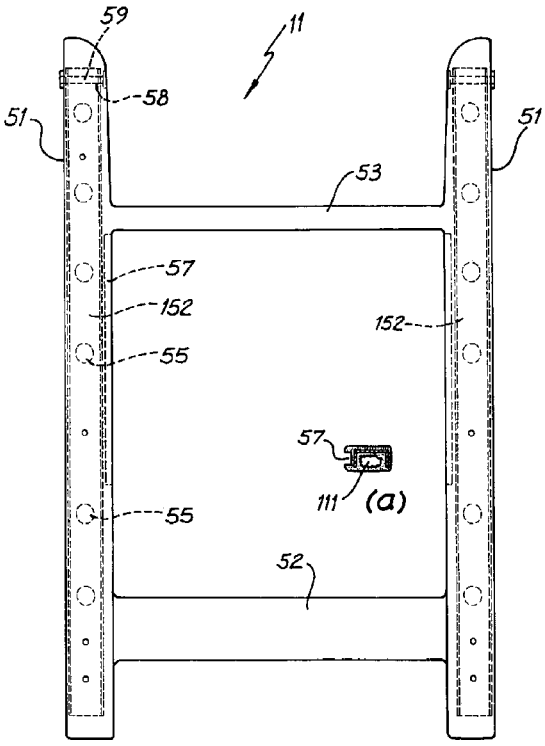

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 9-14 is confirmed.

Claims 1-8 and 15-20 are cancelled.

New claim 21 is added and determined to be patentable.

*21. A flat-folding plastic chair comprising:*

*a main frame, a support frame and a seat frame;*

*the main frame hinged to an upper portion of the support frame;*

*the seat frame pivotally attached to and supported by a seat pivot member located in an intermediate portion of the main frame;*

*the support frame having two legs, the support frame and the two legs being fabricated from molded plastic;*

*each leg reinforced by an internal insert;*

*the seat frame has side members, each side member comprising a web below which is located a network of reinforcing ribs;*

*the side members each reinforced with an insert;*

*the network of reinforcing ribs further comprises two parallel ribs; and,*

*a boss transversing the parallel ribs so as to provide a thickened position having a transverse bore.*

* * * * *